United States Patent [19]

Knapp et al.

[11] 4,227,568

[45] Oct. 14, 1980

[54] DRIVE SYSTEM FOR A CERAMIC REGENERATOR

[75] Inventors: Charles A. Knapp, Grosse Pointe Woods, Mich.; Gary L. Boyd, Tempe, Ariz.

[73] Assignee: Ford Motor Company, Dearborn, Mich.

[21] Appl. No.: 17,291

[22] Filed: Mar. 5, 1979

[51] Int. Cl.[3] ..... F28D 19/00

[52] U.S. Cl. ..... 165/8; 165/10; 74/443

[58] Field of Search ..... 165/8, 10; 74/443

[56] References Cited

U.S. PATENT DOCUMENTS

| | | | |
|---|---|---|---|
| 1,785,812 | 12/1930 | Gribben | 74/443 X |
| 3,257,860 | 6/1966 | Runde et al. | 74/443 X |
| 4,148,354 | 4/1979 | Rao | 165/8 |

*Primary Examiner*—Albert W. Davis

*Attorney, Agent, or Firm*—Donald J. Harrington; Keith L. Zerschling

[57] ABSTRACT

A regenerator drive system for a ceramic circular regenerator core comprising a cylindrical matrix adapted to be mounted for rotation about its central axis, said ceramic core having axial gas flow passages adapted, when it is installed in an engine, to accommodate flow therethrough of high temperature combustion gases and relatively cool combustor intake gases, a metallic ring gear surrounding the periphery of said core and radially spaced therefrom, an elastomeric lug and groove drive means situated between said core and said ring gear for distributing tangential driving forces therebetween, said drive means comprising a first series of elastomeric drive lugs bonded to the inner periphery of said ring gear at tangentially spaced locations and a second series of elastomeric drive lugs bonded to the external surface of the periphery of said core at tangentially spaced locations and in registry with the spaces between the drive lugs on said ring gear, said drive lugs having sufficient clearance therebetween to establish radial and axial compliance between the ring gear and the core, one with respect to the other.

3 Claims, 1 Drawing Figure

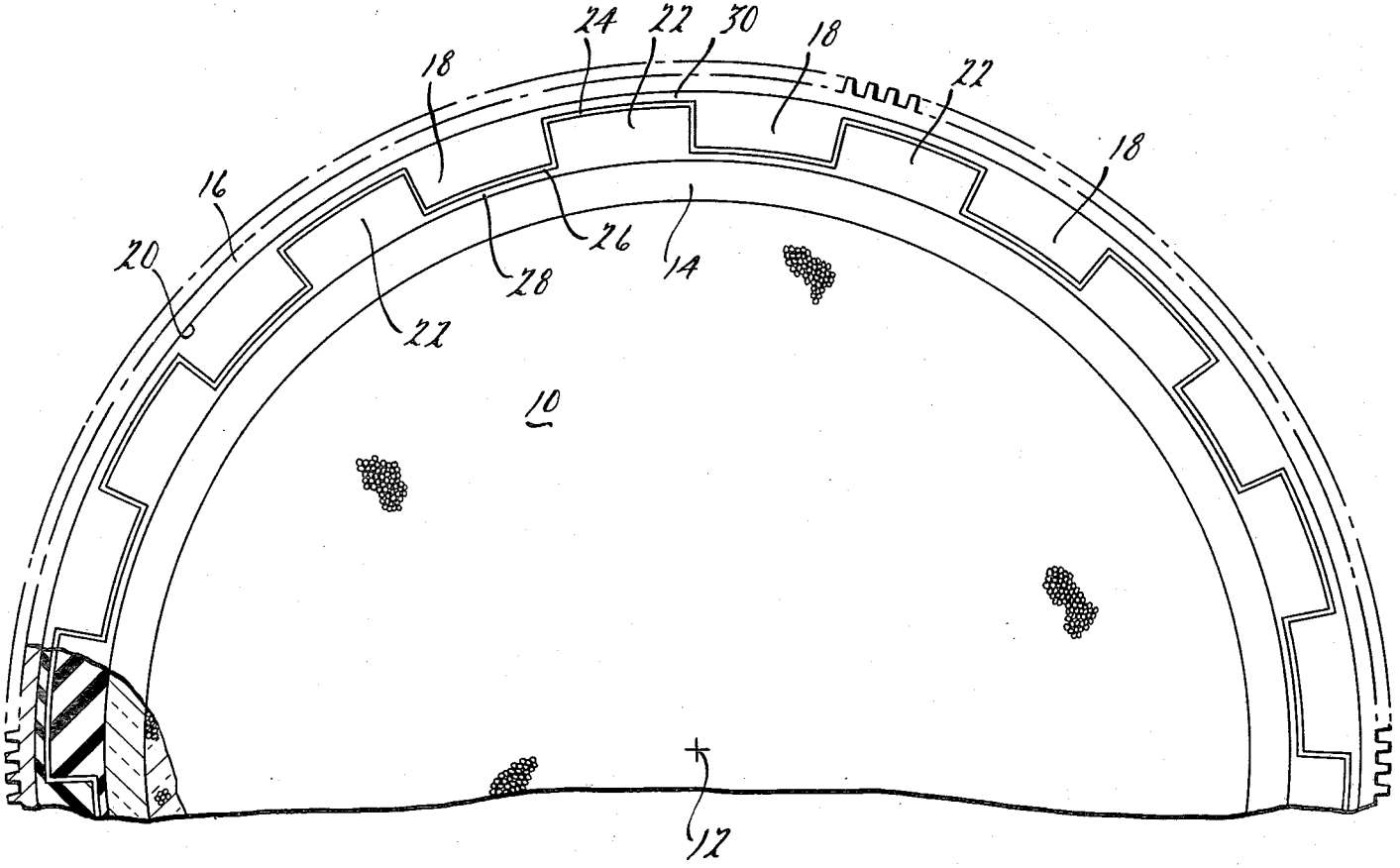
18
22
18
30
22
24
26
28
18
22
16
20
14
10
12

DRIVE SYSTEM FOR A CERAMIC REGENERATOR

BRIEF DESCRIPTION OF THE INVENTION

Our invention comprises inprovements in regenerator drives of the kind shown in the U.S. Pat. Nos. 3,623,544; 3,848,663; 3,311,204; 3,525,384; 3,430,687 and 3,496,993. These references show various means for establishing a driving connection between a ring gear and a circular, ceramic regenerator core. They show also various means for establishing radial compliance between the ring gear and the core to avoid stressing the ceramic material of the core as driving torque is distributed through the driving connection to establish rotation of the core as the heated regions of the core are brought into registry with the relatively cool gas flow passages of the engine. Reference may be made also to co-pending application Ser. No. 17,293, filed Mar. 5, 1979 for an alternate elastomeric resilient regenerator drive means for connecting a regenerator core to a ring gear, which is assigned to the assignee of this invention.

In each of these prior art references, as well as in the co-pending application, the elastomeric material is described as a torque transmitting member, and it distributes either compressive forces or tension forces between the ring gear and the core while providing either axial compliance or radial compliance, or both, between the core and the ring gear. Our present invention also uses an elastomeric material as the torque distributing element. The elastomeric material is formed into lugs that are bonded to the inner periphery of the ring gear at circumferentially spaced locations. Elastomeric lugs also are bonded to the outer periphery of the regenerator core and arranged at circumferentially spaced locations. The lugs on the ring gear register with the spaces between the lugs on the core, thus establishing a drive connection between the ring gear and the core. Spacing is provided between the lugs to accommodate a floating disposition of the core with respect to the ring gear.

In an engine installation the ring gear is supported on the engine housing bulkhead, usually by rollers, and its axial position thus is established by the housing. The seals of the regenerator that effectively isolate the hot gas flow portions from the cold gas flow portions of the matrix are usually leaf type seals that rub against the axial surfaces of the core. Thus the core tends to be positioned at its appropriate location by the seals to permit the most effective sealing. Any inconsistency between the tendency for the ring gear to position the core at one location and the tendency for the seal structure to position it at a different location is eliminated.

In prior art constructions, including some of those illustrated in the aforementioned prior art patents, there is a tendency for the elastomeric material to shrink because of aging and also because of the temperature reversals that occur during operation. When load is transmitted through the elastomer material, either through compressive forces or tension forces, there is a tendency for the material to break thereby interrupting the torque transmitting path between the ring gear and the core. Shrinkage of the elastomeric material in the drive system of our invention, however, does not interfere with the torque transmitting ability of the drive means since the torque is transmitted from one lug to the other without the necessity for stressing a beam or bridge portion of the elastomer. This feature is achieved while eliminating radial compressive loads on the ceramic core.

BRIEF DESCRIPTION OF THE DRAWING

The single view of the drawing is an end view of a regenerator drive system having our improved load transfer means between the core and the ring gear.

PARTICULAR DESCRIPTION OF THE INVENTION

Reference numeral 10 designates a ceramic regenerator core which is adapted for rotation about its geometric center 12. It may be formed of magnesium aluminum silicate material. It is comprised of a plurality of gas flow passages in the core material. It is mounted, as shown in the previously described reference patents, in an engine housing and is disposed in the path of the heated exhaust gases and in the path of the relatively cool combustor intake gases. The cooler gases pass through a region of the regenerator core that is isolated by suitable seal structure from the region that accommodates the heated gas flow. To strengthen the periphery of the ceramic regenerator, filler material 14 is inserted into the flow passages to provide structural support.

A ring gear 16 surrounds the periphery of the core 10. It is adapted to engage a drive pinion which is journalled in the engine bulkhead. The ring gear is supported on rollers or other sutable bearing means which are positioned by the engine bulkhead.

A series of elastomer lugs 18 is secured by bonding to the inner periphery 20 of the ring gear 16. The lugs are tangentially spaced as shown on the drawing so that a substantial spacing is provided between each lug 18. A corresponding series of lugs 22 is bonded to the outer peripheral surface of the regenerator core 10. The lugs 22 are positioned in the spaces between the lugs 18. By preference a gap of approximately 1/32 of an inch is provided at the outer diameter of the lugs 22 as shown at 24. A corresponding clearance at the internal diameter of the lugs 18 of approximately 1/32 of an inch also is provided as shown at 26. These clearances are substantially reduced when the regenerator drive is operated at its normal operating temperature, which may be about 350° F.

The elastomer, the bonding material and the method for bonding may be the same as that described in the co-pending application previously identified in this specification.

If desired, the lugs 22 can be joined together by a connecting strip of elastomer as shown at 28 although we contemplate that the strip can be eliminated if desired since sufficient bond surface between the lugs 22 and regenerator core can be achieved without a strip 28. Similarly, a corresponding strip 30 can be provided as a connection between the lugs 18 if additional bonding area is necessary. When driving forces are transmitted from the ring gear to the core, the drive system acts as a compression reaction system by reason of the engagement of the lugs and the grooves in the elastomer. The spacing between the lugs can be achieved by using an ablative shim made of known materials that disintegrate or vaporize at operating temperatures. The shim can be inserted between the ring gear and the core prior to injection of the elastomer into the space. It is possible, however, that other fabrication techniques can be used to establish the shape of the lugs and the spaces between the adjacent lugs as well as the radial spacing for the lugs. For example, a stationary molding fixture can be used for the core to form the radially disposed lugs on the core periphery and a separate stationary molding fixture can be used for molding the internal lugs on the ring gear in proper spaced relationship.

Having described a preferred embodiment of our invention, what we claim and desire to secure by U.S. Letters Patent of the United States is:

1. A regenerator construction comprising a ceramic cylindrical core having axial gas flow passages therein, a ring gear surrounding said core, said ring gear being radially spaced with respect to said core to define an annular space therebetween, and an elastomeric drive means situated in said space, said drive means comprising a plurality of elastomeric drive lugs bonded to the inner surface of said ring gear at tangentially spaced locations, a plurality of external elastomeric drive lugs bonded to the external peripheral surface of said core at tangentially spaced locations, the drive lugs on said ring gear being spaced to define tangentially arranged spaces therebetween, the lugs on said core registering with said spaces thereby establishing a compression reaction drive system for transmitting drive forces between said ring gear and said core.

2. The combination as set forth in claim 1 wherein the drive lugs on said core are formed so that precalibrated clearances are established between the tangential sides of said core lug and the adjacent sides of the ring gear lugs.

3. The combination as set forth in claim 2 wherein predetermined radial clearances are provided between the outer surfaces of said core lugs and the inner surfaces of said ring gear and predetermined clearances also are provided between the inner surfaces of said ring gear lugs and the outer surface of said core.

* * * * *